US005170048A

United States Patent [19]

Becker

[11] Patent Number: 5,170,048

[45] Date of Patent: Dec. 8, 1992

[54] OPTIC SIGNALS PROCESSOR INCLUDING A CHARGE-COUPLED DEVICE, NOTABLY A BIAS SUPPRESSOR FOR A TIMING INTEGRATION CORRELATOR

[75] Inventor: Alain Becker, Montrouge, France

[73] Assignee: Thomson-CSF, Puteaux, France

[21] Appl. No.: 648,906

[22] Filed: Jan. 31, 1991

[30] Foreign Application Priority Data

Feb. 2, 1990 [FR] France ..... 90 01233

[51] Int. Cl.[5] ..... H01J 40/14

[52] U.S. Cl. ..... 250/208.1; 324/77 K

[58] Field of Search ..... 250/211 J, 280.1, 208.2, 250/208.3, 214 R, 214 B; 358/213.15, 213.27; 324/77 K

[56] References Cited

U.S. PATENT DOCUMENTS 4,547,864 10/1985 Kawabata .
4,722,596 2/1988 Labrum et al. ..... 324/77 K
4,797,561 1/1989 Tajiri et al. ..... 358/213.15
4,833,636 5/1989 Miida et al. .
4,985,618 1/1991 Inada et al. ..... 250/208.1

FOREIGN PATENT DOCUMENTS 2409552 6/1979 France .

OTHER PUBLICATIONS

Acousto-Optic Signal Processing-GEC Journal of Research; vol. 2, No. 2 1984, pp. 88-95.

*Primary Examiner*—David C. Nelms
*Attorney, Agent, or Firm*—Roland Plottel

[57] ABSTRACT

In the disclosed optic signals processor, a term-by-term subtraction is made of the N homologous values of two series of values resulting from the integration of a light energy that selectively strikes respective photoactive pixels of a charge-coupled device. This charge-coupled device includes the following on one and the same component:

an image zone having a first array of at least one line having 2N cells, each formed by a photoactive pixel integrating the light energy corresponding to one of the 2N terms of the two series of N values, by accumulation of a corresponding electrical charge, a transfer zone receiving the charges that have accumulated in the cells and including, for said line or for each of said lines, subtractor means successively receiving, at input, each of the two homologous charges that has been transferred from point to point along the line up to the transfer zone, and delivering, at output, a resultant charge proportional to the difference between the two charges applied at input, and reading means to detect said successive, resultant charges delivered by the transfer zone and to convert them into an electric voltage or current signal.

12 Claims, 3 Drawing Sheets

OPTIC SIGNALS PROCESSOR INCLUDING A CHARGE-COUPLED DEVICE, NOTABLY A BIAS SUPPRESSOR FOR A TIMING INTEGRATION CORRELATOR

BACKGROUND OF THE INVENTION

1. Field of the Invention

The present invention relates to an optic signals processor, notably a time integrating correlator, comprising a charge-coupled device or CCD.

It is known that CCDs can be used to carry out the optic processing of a signal (i.e. after this signal has been converted from an electrical signal into an optic signal), especially in two-dimensional processors that perform real-time optic processing of signals such as those delivered by radar receivers or telecommunications receivers.

In this context, it must be specified that although the following description relates to an application of the invention to a two-dimensional time integration correlator, this example is used purely as an illustration: the present invention is quite broader in its scope than the particular example itself.

More precisely, the present invention can be applied to any optic processor of data applied to the detection of a beam by a CCD, whether one-dimensional (CCD linear array) or two-dimensional array, provided that this processor has to perform the term-by-term subtraction of two series of data, for example, the subtraction of two vectors (in the case of a one-dimensional array) or of the lines or columns of two matrices (in the case of a two-dimensional array).

2. Description of the Prior Art

The principle of the optic processing of signals is known. According to this principle, when the bandwidths exceed values permissible in electronics, the electrical signal to be analyzed is converted into a modulated beam. This modulation may be done either by the direct modulation of a source (typically a laser diode) or by the indirect modulation of a continuously emitting laser source using, for example, an opto-electronic component.

Then, using deflector means such as acousto-optic means, the modulated beam is made to scan in one or two directions corresponding to the dimensions of the correlation space.

Various configurations of optic processors using this technique are described in an article by P. V. Gatenby and R. J. Sadler, *Acousto-Optic Signal Processing* in *GEC Journal of Research,* Vol. 2, No. 2, 1984, pp. 88 to 95, which may be consulted for fuller details.

The basic configuration of an optic processor such as this is shown schematically in FIG. 1 of the appended drawings, in an example corresponding to the optic processing of the signal $s_n(t)$ coming from a radar receiver, in order to determine the ambiguity function by time integration in the space $D/f_D$, i.e. the distance/-speed space (the speed being represented by the Doppler frequency).

In this processor, a first beam from a laser source S is modulated at 1 by the signal $s_n(t)$ coming from the radar receiver. The modulated beam produced is deflected in the horizontal direction (with respect to the convention of the drawing) by an acousto-optic modulator 2 controlled by a sampled signal $p(f_i)$ corresponding to the N samples of the distance-domain for the signal $s_n(t)$.

A second signal is deflected in the perpendicular direction by a second acousto-optic modulator 3, controlled by a signal $r_m(t)$, which is also sampled, corresponding to M Doppler ports of the signal $s_n(t)$.

The two resultant beams then strike a charge-coupled device 4 (shown separately in a plane view, and then in detail, in FIG. 2) formed by an array 10 of M lines 11 of N cells 12 each. Only one of these lines has been shown in FIG. 2.

It is known that that each exposed pixel of an image zone (referenced ZI in FIG. 2) of a charge-coupled device picks up an incident light flux and converts the corresponding energy into an electrical charge. This electrical charge is stored at the location of the pixel in an electrical capacitor and gets increased throughout a period of exposure, known as the "integration time".

The resultant charges are then transferred from one point to the next one in the array until (either directly as shown in FIG. 2 or through a non-photoactive buffer zone called a "memory zone"), they reach a component 40 capable of detecting each stored charge and of converting it into a voltage or current that can be used by the processing circuits 5 placed downline.

The result of the processing operation performed by the circuits 5 will be the ambiguity function, shown at 6, making it possible to determine the position of the target tracked by the radar in the domain (distance and velocity).

One of the difficulties encountered in this processing operation is related to the fact that, when optic methods are used, it is a light energy and no longer a simple signal voltage that will be integrated. As a result, the charge produced in each cell by the charge-coupled device will take the form of a quadratic sum of two terms (which shall be described in greater detail here below) that therefore break down into a sum of two squared terms and one product term.

The product term of this quadratic sum constitutes the useful signal of the correlation, while the sum of the two squared terms constitutes the mean component of the base level or bias, which gets added on to the useful signal and to the correlation pedestal.

The presence of this bias component creates a two-fold difficulty:

First of all, it increases the absolute value of the resultant signal, since the useful signal is increased by the bias component, which is far greater than the weakest signals.

The consequence of this will be a notable increase in the dynamic range of integration, for it will be necessary to integrate the total signal to subsequently recover only the useful signal therefrom at output.

It will be noted, in this context, that the increase in the dynamic range comes from the fact that the procedure uses optic means, integrating no longer a voltage but a signal power (quadratic detection), thus doubling the necessary dynamic range.

Secondly, it is not possible to predict the value that should be deducted from the result to extract the useful signal: the level of the bias component is not constant for, as shall be explained further below, it depends on (among other factors) the mean value of the signal.

A special processing to suppress this bias must therefore be provided for.

It will be noted, incidentally, that this term "bias" will generally include the continuous component (which, for its part, is constant in principle) added on to the modulating signal during the modulation so that the negative components of the useful signal can be processed, in shifting this useful signal towards the positive values.

The remedy proposed in the prior art consists in using two components that are phase-shifted by radians with respect to each other, in simultaneously carrying out two correlations in two identical charge-coupled devices. and in taking the difference between the samples resulting from these two correlations, so as to thus extract only the useful signal therefrom.

For, the phase-shifting of one of the modulating signals will change the sign of the above-mentioned product term, hence the sign of the useful component of the signal but not the sign of the two squared terms (owing to the squaring operation). The subtraction of the two resulting samples will enable the elimination of these squared terms, only the useful component of the signal being preserved.

The theoretical aspects of this processing are, for example, developed in an article by M. W. Casseday, N. J. Berg, I. J. Abramovitz and J. N. Lee, *Wide-Band Signal Processing Using The Two-Beam Surface Acoustic Wave Acousto-Optic Time Integrating Correlator,* in the *IEEE Transactions On Sonics And Ultrasonics,* Vol. SU-28, No. 3, May 1981, pp. 205 to 212, which may be consulted for fuller details.

In practice, a configuration such as the one illustrated in FIG. 1 is used by splitting the optic beam, generated by the optic source S, into two and also by splitting the beam at output of the first acousto-optic modulator into two, by means of a beam separator, and by modulating the second branch of the input beam by an acousto-optic component 3' that is similar to the component 3, but is controlled by a signal $r_m^*(t)$ phase-shifted by $\pi$ in relation to the signal $r_m(t)$.

The resultant beam produced by this second branch strikes a second charge-coupled device 4', identical to the charge-coupled device 4.

One of the two signals coming from the respective charge-coupled devices 4 and 4' is then subtracted from the other one by a circuit 7 enabling the suppression of the bias, before these two signals are applied to the processing circuit 5.

However, while this approach is satisfactory in theory, it has two series of practical drawbacks.

First of all, it makes it necessary to split the beam into two and, hence, to duplicate the optic components, with the numerous difficulties entailed by duplication, notably:

the increase in the cost, due to the duplication of the components, the addition of a beam separator upline and of a processing circuit downline, to obtain the difference between the signals, the necessary correction of the relative dispersals of the components of the two branches (notably that of the charge-coupled devices), the optic problems of alignment of the beams, notably if it is desired to provide for efficient the drastic need to avoid optic or electrical saturation in one of the branches, in order to have no loss of signal;

the major degradation of the signal-to-noise ratio owing to the additional noise factor introduced by the additional active components added to the chain.

The second series of drawbacks relates to the fact that the prior art approach provides no remedy to the loss of dynamic range introduced by the bias, which is suppressed only downline of the charge-coupled devices.

A major part of the dynamic range is lost because it is necessary to integrate not only the useful signal proper to be correlated (or to be processed in another way) but also the correlation pedestal component: this correlation pedestal component will be subsequently suppressed but its inherent level is already of the order of 70 dB. Furthermore, it is necessary to be in a zone of operation that is not subject to compression of the level, otherwise suppression of the bias will be made impossible.

Besides, the best CCDs available at present, for example those marketed under the brand name of Dynasensor by Dalsa Inc., only have a dynamic range of the order of 120 dB. The limits of this dynamic range are essentially dictated by the risk of saturation of each pixel under the effect of an excessively prolonged illumination (by the effect of overflow on to the neighboring pixels) and above all of saturation of the electrical reading amplifier of the detection circuit (a dynamic range of 120 dB corresponds to a range of voltage values that may go from 10 nV to 10V, which amounts to a considerable voltage difference). In many applications, however, this 120 dB limit is still insufficient for some processing operations or for some measurements to be made.

It would therefore desirable to have a dynamic range that is notably greater than 120 dB, even if what is to be used is only the upper 120 dB of the range, which contain the useful zone of the signal after suppression of the bias component as well as of the correlation pedestal.

It is true that, to this end, the dynamic range could be increased through the use of two distinct charge-coupled devices: the first one works like a standard CCD and the second one, placed downline with respect to the first one, is not photoactive but is used to carry out a second integration while the basic integration continues in the first component.

However, there would be major deterioration in the signal-to-noise ratio, for the use of two separate components necessarily dictates a dual signal conversion (the conversion of the charge into a voltage or a current, to come out of the first CCD array, then the conversion of this voltage or current into a charge, to enter the second CCD array): this constraint entails heavy penalties owing to the noise factor introduced by the active components carrying out these conversions.

Furthermore, this noise will be greatly increased by the number of inter-CCD transfers that will be needed to obtain the result.

Finally, such a technique would entail a major increase in the total integration time, owing to the charge transfer time, which is of the order of one microsecond per sample: this would give a total time of four seconds for each transfer in an array of 2000 × 2000 pixels for example (in the case of a single output) or two milliseconds in the case of 2000 parallel outputs.

SUMMARY OF THE INVENTION

The invention proposes to overcome all these drawbacks by means of an optic signals processor, notably a bias suppressor, for a time integrating correlator, of the above-mentioned general type, i.e. of the type wherein the N homologous values of two series of values are subtracted term by term, these values resulting from the integration of a light energy that selectively strikes respective photoactive pixels of a charge-coupled device.

However, unlike the prior art, the invention essentially proposes the use of a charge-coupled device configured so as to enable the direct suppression of the bias within the component itself (hence without deterioration in the performance characteristics, notably as regards the dynamic range and the noise) while, at the same time, preserving the total integrity of the signal.

By thus suppressing the generated bias within the charge-coupled device itself, the invention enables the most efficient use of:

the entire dynamic range of the reading amplifier in the case of a direct use, the entire dynamic range of integration possible, should a second integration be done downline, this second integration being then preferably done directly on the same component, by transfer of charges, hence by the manipulation of data containing the maximum amount of useful information on the result of the correlation.

Also suppressed are the problems of dispersal among charge-coupled devices and among reading amplifiers. These are problems that arose when two distinct charge-coupled devices had to be used.

To this effect, according to the invention, the charge-coupled device of the processor includes the following on one and the same component:

an image zone having a first array of at least one line having 2N cells, each formed by a photoactive pixel integrating the light energy corresponding to one of the 2N terms of the two series of N values, by accumulation of a corresponding electrical charge, it being possible for this charge to be then transferred from point to point along the line, up to an end of this line, by the sequencing of the charge-coupled device;

a transfer zone receiving the charges that have accumulated in the cells and including, for said line or for each of said lines, subtractor means successively receiving, at input, each of the two homologous charges that has been transferred from point to point along the line up to the transfer zone, and delivering, at output, a resultant charge proportional to the difference between the two charges applied at input, and reading means to detect said successive, resultant charges delivered by the transfer zone and to convert them into an electric voltage or current signal.

Preferably, said line of 2N cells is formed by two parallel elementary lines of N cells each, these elementary lines being sequenced concomitantly, the N pixels of the first elementary line integrating the light energy corresponding to the N respective terms of the first series of values and the N pixels of the second elementary line integrating the light energy corresponding to the N respective terms of the second series of values.

In this case, the two elementary parallel lines of one and the same line are preferably positioned side by side on said component in such a way that two pixels corresponding to the two terms of the same rank in the two series are located in one and the same region of this component.

Furthermore, an arrangement such as this enables the use of a single optic architecture with a phase shift ($0\ \pi$) on each component of the signal $r_m^*(t)$.

In a first embodiment, said subtractor means are capacitive means including, for each line or for each of said lines:

a first capacitor, capable of receiving successively, by transfer from the image zone, each of the N charges corresponding to the first series of values;

a second capacitor, capable of receiving successively, by transfer from the image zone, each of the N charges corresponding to the second series of values when the first capacitor receives the charge having the same rank in the first series of values;

means to switch these two capacitors into opposition prior to each new charge transfer, and means to switch these two capacitors into series after each of the charge transfers so that there appears, on this set of capacitors in opposition, a charge equal to the differences between the charges transferred into the respective capacitors.

In a second embodiment, said subtractor means are also capacitive means but they include, for said line or for each of said lines:

a capacitor, means to couple one of the plates of this capacitor to the cell containing one of the N charges corresponding to the first series of values and to couple the other plate to the cell containing the homologous charge of the second series of values, and means to then couple one of the plates of the capacitor to a constant potential and to uncouple the other plate from the cell to which it had been coupled so that, at this latter plate, there appears a charge proportional to the difference between the two charges contained in the cells to which the capacitor had been coupled.

Furthermore, according to a second aspect of the present invention, it is possible to implement a second level of integration on the same component.

The basic idea consists in broadening the dynamic range of presently used arrays by carrying out a dual integration but by carrying out the second integration directly in the component, without any output of the signal from this component, nor any transformation of the nature of the information between the start and the end of this dual integration.

If it becomes possible to stay within the component instead of coming out of it then, since there is no active component, there will be no additional noise brought in. The processing will then consist of only arithmetical charge-transfer operations.

In this improved form of the processor of the present invention, it is provided, to this effect, that the charge-coupled device further includes a memory zone having a second array of N non-photoactive cells, wherein the number of lines is homologous to that of the first array of the image zone, the transfer zone receiving the charges that have accumulated in the cells of this first array and transferring them to the second array, where they will be stored and read by the reading means;

the line, or each of the lines, of the second array is a feedback line sequenced at the same time as the corresponding line of the first array, and at the same rate, said line including an input and an output, so that it can receive, at this output, the charges introduced at input and transferred from point to point up to the output, and the transfer zone includes:

charge divider means receiving a charge and giving, at output, a charge reduced, in relation to the received charge, by a predetermined division ratio, and means to add this reduced charge to the charge received at output of the feedback line and to reinject the resultant total charge into the input of the feedback line so as to make it recirculate therein. the concomitant sequencing of the lines of the first array and of the second array being repeated in a plurality of cycles so as to bring about an increase, by the accumulation of the successive reduced charges in the feedback line, in the corresponding charge of the memory array and thus, by the second integration that results therefrom, to increase the dynamic range of the charge-coupled device by a proportion corresponding to said predetermined ratio of division.

The charge divider means are standard devices per se, known to those skilled in the art, and they can be made equally well in the form of a capacitive divider or that of an electrical divider (with a controlled potential barrier).

The same is true for the charge adder means.

If the charge divider means are capacitive divider means, the above-mentioned second embodiment can be combined with this improved embodiment.

For, the division of the charges can then advantageously be done directly through said subtractor means which thus include, for said line or for each of said lines:

a capacitor;

means to couple one of the plates of this capacitor to the cell containing one of the N charges corresponding to the first series of values and to couple the other plate to the cell containing the homologous charge of the second series of values, and means to then couple one of the plates of the capacitor to a constant potential and to uncouple the other plate from the cell to which it had been coupled so that, at this latter plate, there appears a charge that is proportional to the difference between the two charges contained in the cells to which the capacitor had been coupled and constitutes said charge reduced by the predetermined ratio of division.

As a variant, said charge divider means may also be electrical divider means.

Preferably, said predetermined ratio of division is of the order of 1:100. This makes it possible to obtain a corresponding increase of 40 dB in the dynamic range.

Advantageously, said feedback line is made on the component in the form of a folded line constituted by two adjacent halves that have the same length and transfer the charges in opposite directions.

The cells of the folded feedback line then advantageously have a width that is approximately that of each of said above-mentioned parallel elementary lines of the first array, so that the homologous lines of each of the arrays have respective widths substantially identical.

BRIEF DESCRIPTION OF THE DRAWING

Other characteristics and advantages of the invention will appear from the following detailed description, made with reference to the appended drawings, of which.

DETAILED DESCRIPTION OF THE INVENTION

Figure 2:
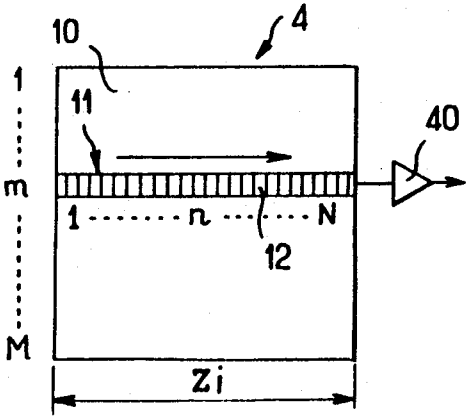
FIG 2 PRIOR ART
FIG. 2 shows the charge-coupled device of the optic processor of FIG. 1, according to the prior art.
Figure 3:
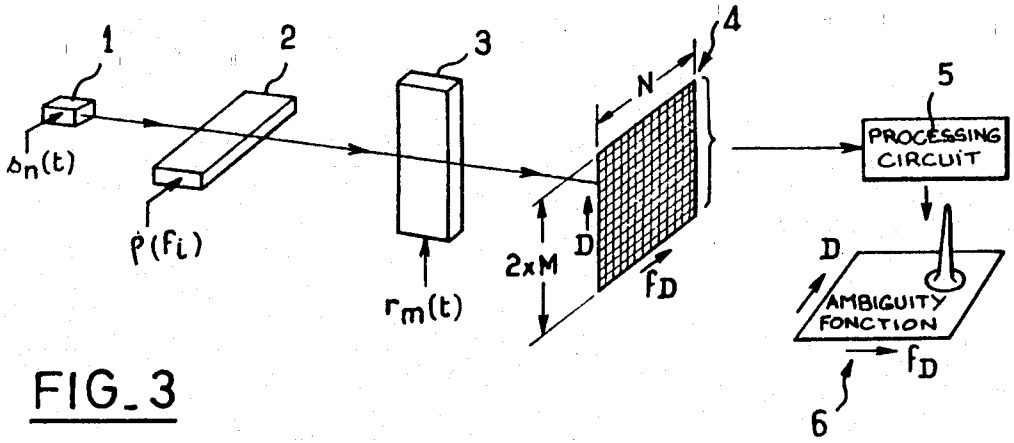
FIG. 3 is homologous to FIG. 1, for the optic processor of the present invention.
Figure 4:
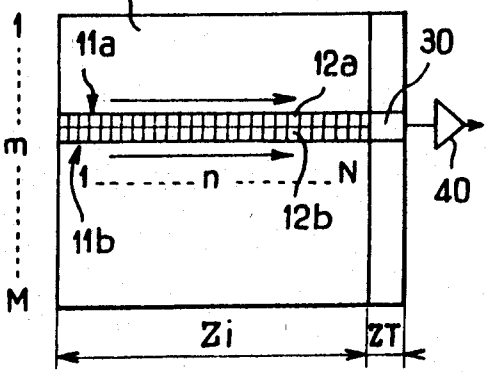
FIG. 4 is homologous to FIG. 2, for the charge transfer device used by the optic processor of FIG. 3.

Referring to FIGS. 3 and 4, we shall now describe the essential principles of the present invention. These FIGS. 3 and 4 are homologous to FIGS. 1 and 2 explained further above, and the same numerical references designate similar elements in the different figures.

Preferably, as shown in FIG. 3, the processor of the invention uses only one beam for each dimension of the processing operation. This removes all the difficulties of alignment, dispersal of the components, behavior under vibrations, etc., inherent in a doubling of the beams modulated by $r_m(t)$.

It will be noted, however, that this characteristic is not indispensable, and it could be imagined that the charge-coupled device 4 is illuminated jointly by two distinct beams, each producing one of the two signals phase-shifted by $\pi$, although this configuration is, a priori, less useful than the one with a single beam.

Figure 1:
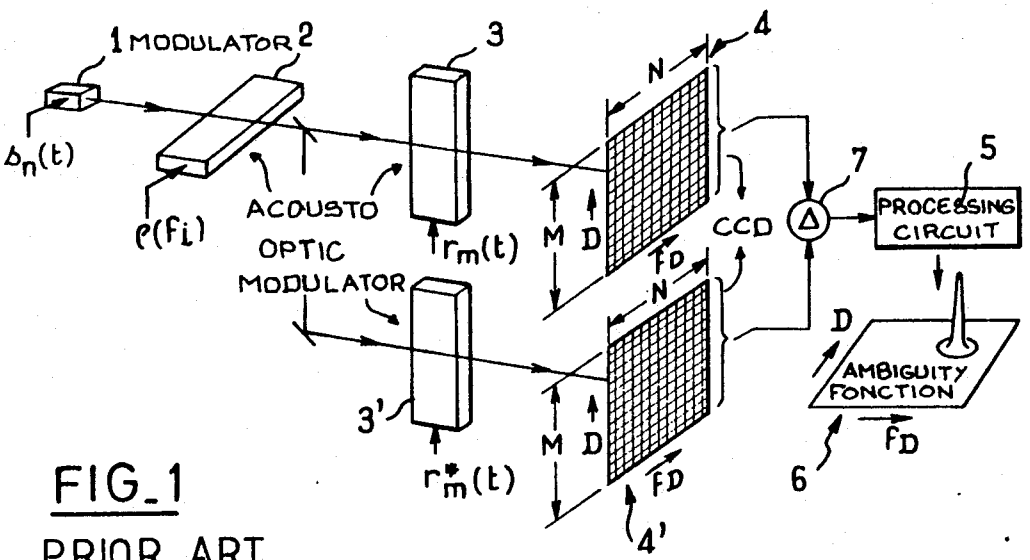
FIG 1 PRIOR ART
FIG. 1 shows an optic processor of signals with bias suppression according to the prior art.

In any case, and unlike the processors of the prior art, the processor of the invention uses only one charge-coupled device 4. This makes it possible to suppress the subtractor stage 7 (FIG. 1).

This one-piece charge-coupled device 4 has an array of (2M) $\times$ N cells on one and the same component, each line 11 being actually split up, as can be seen in greater detail in FIG. 4, into two identical elementary lines 11*a* and 11*b* of N cells each, respectively designated 12*a* and 12*b*, each receiving one of the two signals phase-shifted by $\pi$ radians designed, as referred to further above, to enable the suppression of the bias by combination.

The cells 12*a* and 12*b* of the image zone ZI have a standard structure, each corresponding to a photoactive pixel receiving an elementary light energy $h\nu$ and converting it into an electrical charge which will increase as and when the illumination increases (through the phenomenon of integration of the light flux).

The charges that have accumulated in the respective cells 12*a* and 12*b* will be combined, in the manner that shall be explained here below, by a subtractor circuit 30, located in a transfer zone ZT adjacent to the image zone ZI, before being applied to the detection amplifier 40.

The detection amplifier 40 will convert the charges stored in the memory zone into electrical voltage or current signals and will deliver them to the exterior for subsequent processing. This aspect of the component is a standard one per se and shall therefore not be explained in detail. However, it can be pointed out that it is possible to use every known reading method, i.e. chiefly the simultaneous reading, in parallel, of all the lines of the array (with, in this case, as many amplifiers 40 as there are lines) or the successive reading of the different lines, each being transferred in sequence into the buffer register formed by a shift register having the same number of pixels as each of the lines of the memory zone and connected, in this case, to a single detection amplifier 40.

Very advantageously, the two elementary lines 11*a* and 11*b* correspond to a same line 11 (i.e. To a same element m of the M samples) placed side by side, in order to obtain the most efficient possible use of the local uniformity of the crystal on which the charge-coupled device is made (this configuration further facilitates the interconnection of the two elementary lines of each line 11 and simplifies the optic alignment of the beam with respect to the components).

It may be noted that, although this variant has not been illustrated, the charge-coupled device, in a manner known per se, may also include a non-photosensitive memory zone in addition to the image zone ZI. This non-photosensitive zone will have the same dimensions (in terms of the number of cells) as the photosensitive image zone (ZI) and will serve as a buffer zone in which the charges are transferred from the image zone before reading by the detection amplifiers 40.

We shall now explain the way in which the signal is processed by this processor.

The light beam emitted by the source 1 is modulated by a sampled signal $s_n(t)$ corresponding to the signal to be analyzed, with the form:

$$s_n(t)=S_n(t)\cos\omega t, \text{ with } n\epsilon[1,N],$$

This signal will be correlated with a reference signal, also sampled, having the form:

$$r_m(t)=R_m(t)\cos(\omega t+\phi), \text{ with } m\epsilon[1,M].$$

For the sample (m,n) and at the end of the integration time T (with $t \epsilon (0, T)$, the correlation product will be an expression with the form:

$$S_0(m,n)=\sum_{t=0}^{T} E(m,n,t).$$

with $$E(m,n,t)=[s_n(t)+r_m(t)]^2.$$

or again:

$$E(m,n,t)=s_n^2(t)+2s_n(t)\,r_m(t).$$

whence we derive $$S_0(m,n)=\sum_{t=0}^{T} s_n^2(t)+\sum_{t=0}^{T} r_m^2(t)+2\sum_{t=0}^{T} s_n(t)r_m(t).$$

If, in this expression, $s_n^2(t)$ and $r_m^2(t)$ are substituted by:

and $$s_n^2(t)=\tfrac{1}{2}.S_n^2(t).[1+\cos 2\omega t]$$

$$r_m^2(t)=\tfrac{1}{2}.R_m^2(t).[1+\cos(2\omega t+2\phi)].$$

we obtain:

$$S_0(m,n)=\tfrac{1}{2}\sum_{t=0}^{T} S_n^2(t)+\tfrac{1}{2}\sum_{t=0}^{T} R_m^2(t)+2\sum_{t=0}^{T} s_n(t)r_m(t)$$

The cosine terms of $s_n^2(t)$ and $r_m^2(t)$ have a double frequency (2 wt) and hence have null average on the integration time.

There therefore remains an expression formed, firstly, by two terms:

$$\tfrac{1}{2}\sum_{t=0}^{T} S_n^2(t)+\tfrac{1}{2}\sum_{t=0}^{T} R_m^2(t).$$

constituting the bias to be suppressed and, secondly, a third term:

$$2\sum_{t=0}^{T} s_n(t)r_m(t).$$

corresponding to the useful signal.

The suppression of the bias is obtained by using two samples $r_m$ and $r_m^*$ phase-shifted by $\pi$ radians. This gives, for the sample $r_m^*$, a quadratic sum $S_\pi(m,n)$, homologous to the quadratic sum $S_0(m,n)$ of the sample $r_m$, having the form:

$$S_\pi(m,n)=\tfrac{1}{2}\sum_{t=0}^{T} S_n^2(t)+\tfrac{1}{2}\sum_{t=0}^{T} R_m^2(t)-2\sum_{t=0}^{T} s_n(t)r_m(t).$$

If we take the difference between th two quadratic sums corresponding to the two signals, mutually phase-shifted by $\pi$, we obtain:

$$S_0(m,n)-S_\pi(m,n)=4\sum_{t=0}^{T} s_n(t)r_m(t).$$

which represents the result sought.

It will be noted that this result is proportional to the value of the correlation signal and not to its square, as would be the case for a direct integration (where two distinct beams are used, as in FIGS. 1 and 3).

Figure 6:
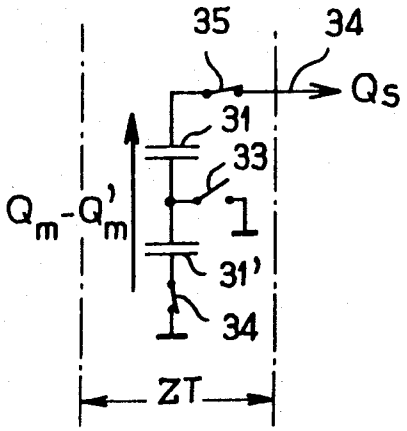
FIG. 6 shows the transfer zone ZT of FIG. 5, in another phase of operation.
Figure 5:
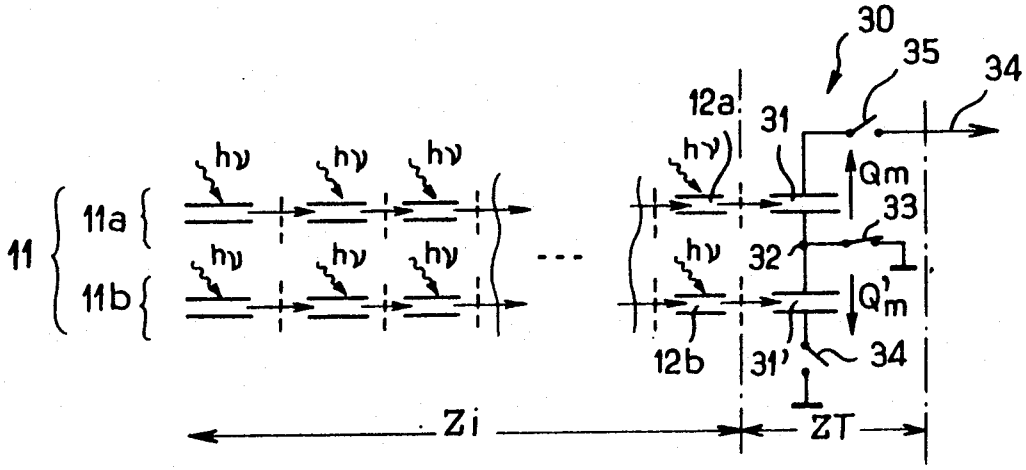
FIG. 5 is a detail of FIG. 4, corresponding to a horizontal line taken out of the charge transfer device.

FIGS. 5 and 6, on the one hand, and 7 and 8, on the other hand, respectively show two possible embodiments of the subtractor circuit 30 of the transfer zone ZT.

In these figures, and in the following ones, lines of dots and dashes are used to show the different potential barriers between the cells of the component. The means used to achieve coordinated control over these different potential barriers are standard means per se, and have not been shown for clarity's sake.

The circuit 30 has the function of obtaining the difference between the charges $Q_n$ and $Q_n$ contained in the respective cells 12*a* and 12*b* of the elementary lines 11*a* and 11*b*.

The purpose of this is to obtain a charge $Q_s$, at output of the circuit 30, that is equal or proportional to the difference $(Q_m - Q'_m)$, i.e. directly proportional to the difference $(S_0(m,n) - S_\pi(m,n)$ explained further above, corresponding to the useful correlation signal free of any bias.

In the first embodiment, shown in FIGS. 5 and 6, the subtractor circuit 30 has two capacitors 31 and 31', having the same capacitance and having their common point 32 connected selectively to the ground (or to a constant potential reference) by switching means 33, for example a MOS switch.

The plate of the capacitor 31 opposite the common point 32 is connected to the output line 34 by means of a switch 35, while the plate of the capacitor 31' opposite the common point 32 is connected to the ground (or to a constant reference potential) by a switch 34.

In a first phase of the cycle, corresponding to the situation of FIG. 5, the midpoint 32 is connected to the ground (switch 33 closed) and the opposite plates of the capacitors 31 and 31' are both left unconnected (switches 34 and 35 opened). Standard methods of CCD technology are then used to transfer the charge $Q_m$ from the cell 12*b* to the capacitor 31'.

For a two-dimensional array, the same procedure is used, simultaneously, for all the other lines of the component.

In the second phase of the cycle, corresponding to the situation of FIG. 6, the switch 33 is opened and the switches 34 and 35 are closed. The two capacitors 31 and 31' are then in a series connection, equivalent to a single capacitor bearing, between the two end plates, a charge $(Q_m - Q'_m)$ that corresponds to the desired differential charge Qs.

This charge Qs will then be transferred by the line 34 either towards the output of the component for detection and amplification or towards a second integration array, as shall be described further below with reference to FIGS. 9 to 11.

Figure 8:
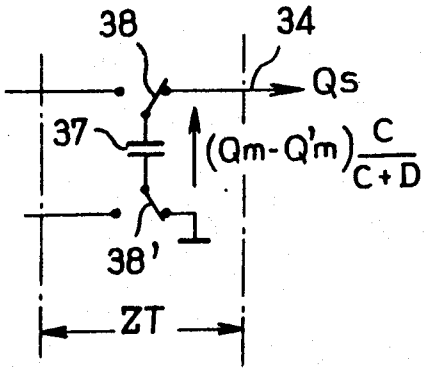
FIGS. 7 and 8 are homologous to FIGS. 5 and 6, for a second embodiment of the invention.
Figure 7:
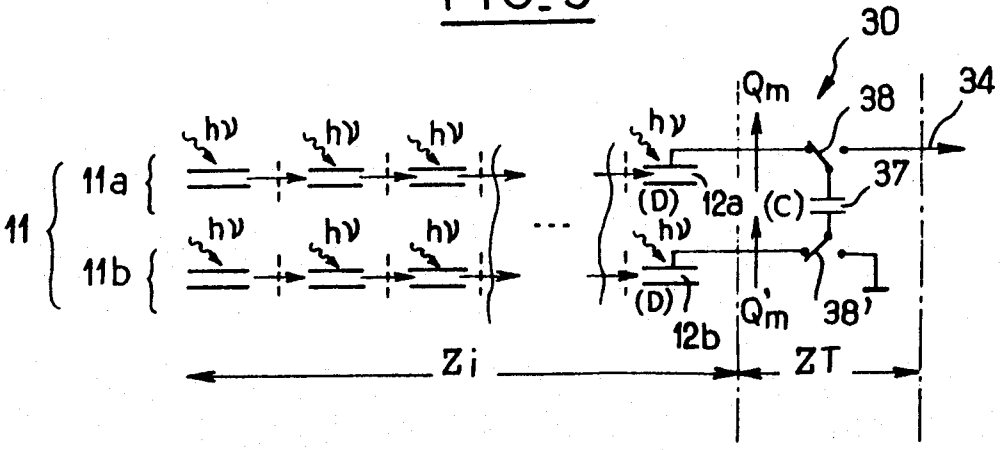

In the second embodiment, illustrated in FIGS. 7 and 8, the subtractor circuit 30 of each of the lines 11 uses a single capacitor 37, with a capacitance C. One of its plates may be connected by a switch 38 either to the cell 12*a* or to the output line 34 while its other plate may be connected, by a switch 38', either to the cell 12*b* or to the ground, or to another constant reference potential source.

In the first phase of the cycle, corresponding to the situation of FIG. 7, the respective plates of the capacitor 37 are connected to the cells 12*a* and 12*b*. This will prompt the pooling of the charge $Q_m$, which was in the cell 12*a*, and of the charge $Q'_m$ which was in the cell 12*b*, between these two cells (each having a capacitance D) and the capacitor 37 (with a capacitance C).

In the second phase of the cycle, corresponding to FIG. 8, the capacitor 37 is uncoupled from the cells 12*a* and 12*b*, its lower plate (namely the one corresponding to the elementary line 11*b*) is grounded by means of the switch 38' and its upper plate (namely the one corresponding to the elementary line 11*a*) is connected to the output line 34 by means of the switch 38.

The result, at the terminals of the capacitor 37, is a charge Qs given by:

$$Q_S = (Q_m - Q_m') \cdot \frac{C}{C + D} \cdot$$

corresponding to the result sought.

It is seen that, in this latter embodiment, it is possible, simultaneously, to carry out the subtraction of the charges and the division of the result of a predetermined ratio n, equal here to (C/C+D). This is particularly advantageous if a second integration is carried out on the component itself, downline of the transfer zone ZT, as shall be explained with reference to FIGS. 9 to 11.

Figure 10:
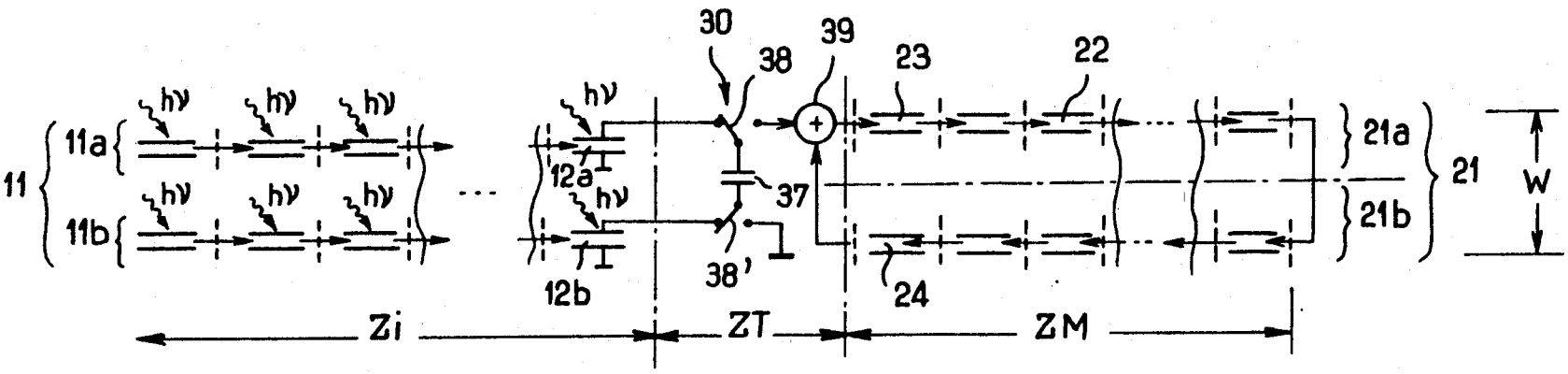
FIG. 10 is a detail of FIG. 9, corresponding to a horizontal line taken out of the component of FIG. 9, with these very same zones.
Figure 11:
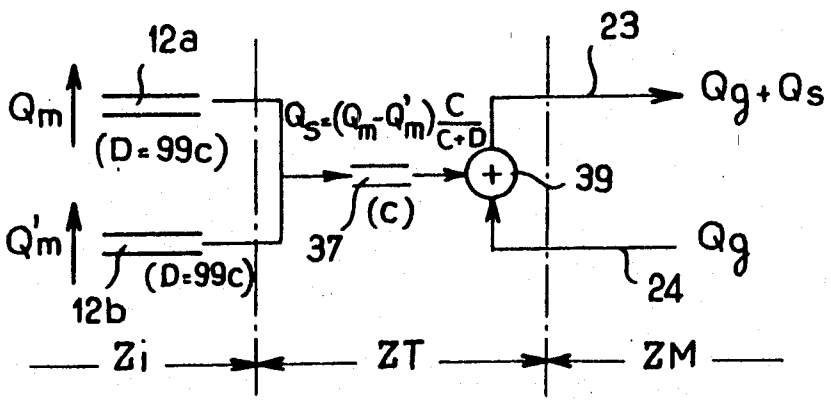
FIG. 11 is an explanatory diagram showing the method for carrying out the successive operations of subtraction, division and accumulation of the charges in the transfer zone of the component (region 30 of FIG. 9).
Figure 9:
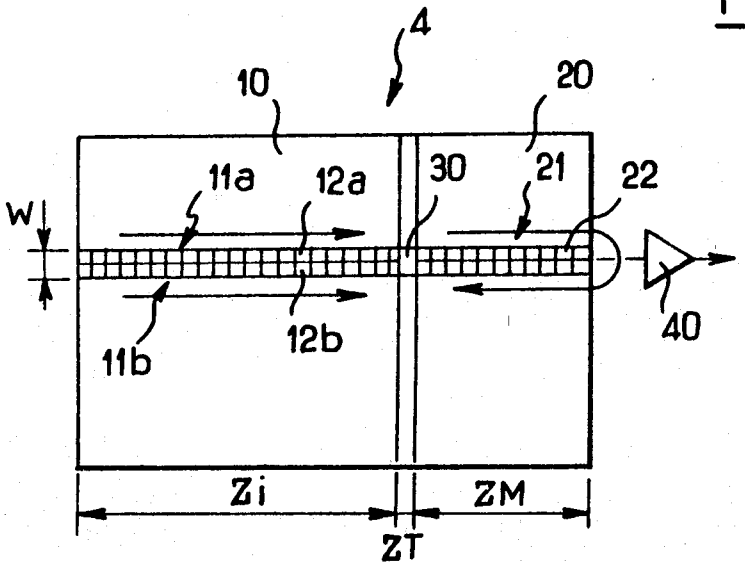
FIG. 9 gives a schematic view of a charge-coupled device according to the invention including, in addition to an image zone ZI and a transfer zone ZT, a memory zone ZM configured so as to carry out a second integration of the signal on the component itself.

The array illustrated in these FIGS. 9 to 11 is that of a charge-coupled device with two separate image and memory zones, as exists already in certain standard charge-coupled devices.

The reference 10 designates the array of the image zone ZI and the reference 20 designates the array of the memory zone ZM. These two arrays are interconnected by the transfer zone ZT, the special structure and working of which are characteristic of this improvement of the invention and shall be described further below.

As is well known, the image zone ZI of the component is photoactive. It integrates the light signal during a given time, until the result reaches a fraction of the saturation level, depending on the desired quality, and, at the end of each integration, it transfers its content to the memory zone ZM.

But an array such as this, in its standard configuration, only transfers the data from the image zone to the memory zone. This transfer is moreover achieved at a high rate, so as to minimize the latency time of the processing operation. The memory zone is then re-read at a slower rate during a new integration cycle of the image zone, to restore the stored information. It is then no longer possible, after the transfer, to continue to integrate the initial optic signal.

Unlike these prior art arrays, the invention proposes essentially, in this improved embodiment with a dual integration level, to preserve the charge in the memory zone for a large number of cycles of integration of the image zone and to make this charge grow, from transfer to transfer, by the addition, to the charge already present in the memory zone, of a fraction of the charge that is stored in the image zone and has just been transferred.

It is thus possible to increase the dynamic range of the CCD array by the fraction of the charge used in the transfer.

We shall now give a more detailed explanation of the structure of the lines of the component, with reference to FIG. 10 (as the case may be, the component may have only one line, in the case of a CCD linear array).

At the end of the integration, the charges that have accumulated in each of the pixels will be transferred, from point to point, up to the transfer zone ZT by appropriate control, according to a precise and coordinated sequencing, of the potential barriers between each of the pixels. This point-to-point transfer of charges by control of the potential barriers between the different pixels or cells is characteristic of all the charge-coupled devices and shall therefore not be described in detail.

The line 21 of the array constituting the memory zone ZM is also a standard one and has a plurality of cells 22, the number of which is equal to the number of cells 12*a*, 12*b* of the image zone ZI. These cells 22 are separated from one another by potential barriers, the control of which, by means of appropriate clock signals, enables the charges to be shifted along the line, from the first cell 23 to the last cell 24.

However, this line 21 of the memory zone has original features as compared with a standard component:

first of all, it is in feedback, i.e. it will be possible to achieve not only a shift but also a recirculation of the charges in the line through the reinjection of the charge of the last cell 24 towards the first cell 23 of the line, this reinjection being done, during the shifting of the charges, by means of an element 39 which shall be described further below;

secondly, the line 21 is made in folded form, i.e. it is made in the form of two parallel and contiguous half lines 21*a* and 21*b*, with the charges flowing in each half line in reverse direction so as to bring the first cell 23 physically to the vicinity of the last cell 24.

It will be noted that this second characteristic (folded line), unlike the first characteristic (feedback line), is not indispensable to the implementation of the invention; there could be an unfolded line 21, with a return link enabling the charge to be brought back from the last cell (which would then be at the far right of the component according to the conventions of the figure) towards the transfer zone, located in the central part of the component.

This long return link would, however, be costly, both in technological terms (the design of the component would be made more complicated) and in electrical terms (owing to the losses introduced by this transfer).

If the second characteristic is used, it is advantageous for the width (the physical dimension in the direction perpendicular to that of the line, namely in the direction vertical to the figure according to its conventional representation) of the cells 22 of the memory zone ZM to be approximately half that of the cells 12 of the image zone ZI, so that the overall width W of the set of two lines placed end to end is substantially constant, thus enabling the surface area occupied by the substrate and the photoelectric efficiency of the component to be optimized (by having contiguous cells).

The transfer zone ZT preferably has subtractor means 30 of the second embodiment explained further above with reference to FIGS. 7 and 8, i.e. means that, in addition to the subtraction, carry out a division of the resultant charge.

These means 30 provide, firstly, for the transfer (after subtraction and division) of the charges of the image zone ZI towards the memory zone ZM and, secondly, in a manner characteristic of the dual integration, for the recirculation of the charges stored in the memory zone and the processing enabling the second integration to be done on these charges.

To this end, the charge on the capacitor 37 will be added to the charge Qg already present in the cell of the line of the memory array corresponding to the pixel in question by means of a charge adder 39, the resultant charge Qg+Qs being reinjected into the line of the array of the memory zone of the following cycle, instead of Qg, in order to make it recirculate therein.

The predetermined division ratio n will be chosen in such a way that the accumulated charge at the end of the final integration time (which is itself dependent on the number of recirculation cycles in the memory zone) reaches a level that is generally smaller than the saturation level of the array.

In the example illustrated, this ratio is 1:100. The capacitances D of the cells 12*a* and 12*b* then have a value D = 99 C, C being the capacitance of the capacitor 37. As a result, we have (C/C+D) = 0.01, and a charge with a value of $0.01 \times (Q_m - Q'_m)$ is recovered at the capacitor 37.

It will be noted, incidently, that it is not necessary to use capacitive charge adder and divider means. But it will also be noted that, instead of these capacitive means, it is possible to use electrical means carrying out (in a manner known per se) a division by means of a controlled electrical field (potential barrier) or prompting a controlled discharge of a fraction $0.99\ Q_m$ of the charge.

We shall now describe the way in which the sequencing of the transfer takes place.

At the instant t of the integration, we will have:

$$t = k.T + (k\text{-}1).T_t \text{ with } 0 < 1 < T2$$

k being the order number of the last integration performed (k being between 1 and a maximum value that corresponds to the planned number of integration cycles, for example 100 cycles);

T being the duration of each of the integrations of the image zone;

$T_t$ being the time of transfer from the image zone towards the memory zone through the transfer zone, and $T_2$ being the total integration time, overlapping the two integrations made respectively and concomitantly in the image zone and in the memory zone.

At the next clock cycle, the charge $Q_s$ is obtained at the capacitor 37.

During this very same elementary clock cycle, the charge $Q_s$ is added to the charge $Q_g$ already contained in the last cell of the memory zone, and obtained by the prior transfers, and this charge is reinjected into the input of this very same line of the memory zone, the charge $Q_g$ thus becoming $Q_g + Q_s$.

This operation is done successively for each of the lines (there may be, for example, 2000 pixels per line) in continuing the two concomitant integrations for the number of cycles desired, for example one hundred cycles of integration.

At the instant $t = T_2$ after the last transfer from the image zone, the integration is stopped.

Then, the charge contained in the memory zone is read, and it is converted into a voltage or a current.

The dual integration has the effect of giving a total dynamic range which is the sum of the inherent dynamic range of the charge-coupled device of the image zone and the charge fraction used by the array of the memory zone. With a division factor n of 1:100 (with, for example, C=1 pF and D=99 pF), a gain of 40 dB is obtained by the second integration, giving a processing dynamic range of 120+40=160 dB, with a component that has little difference from the prior art components in its dimensions and its sequencing.

It will be noted, however, that owing to the noise added to the reading operation downline of the second array and the correlation pedestal, the useful information at output remains in the upper range of the 160 DB of the total dynamic range of the internal processing, and is therefore perfectly usable.

The following are the chief advantages of the invention:

since the signal never leaves the component from the beginning to the end of the integration, the result keeps all its integrity (barring the faults in the charge-coupled device and in their processing);

since the structural differences between this component and presently used components are small, the performance values are increased without any appreciable extra cost, whereas a dual integration using two distinct CCD components would entail a major burden on overall costs;

the signal-to-noise ratio is excellent because the noise is introduced only once (during the final reading, at the end of the total integration time T2) and in only one place (at the output of the component).

What is claimed is:

1. An optic signals processor comprising on one component an image zone (ZI) and a transfer zone (ZT), the image zone having an array of M pairs of lines, each pair having a first and a second line, the transfer zone comprising M lines, with each pair of said lines or line having a rank M, each line of the image zone comprising N photoactive pixels capable of producing when illuminated an electrical charge $Q_m$ and to deliver said charge to a connected cell, each pixel and connected cell having a rank n, each cell of rank n having means for transferring its charge to cell of rank n + 1 at the end of an integrating period, the cell of rank N transferring its charge to the transfer zone, and each line of rank m of the transfer zone having means for receiving the charge of the cells of rank N of the first and second lines of the pair of rank m of the image zone and means for subtracting said charges from one another and for delivering a resultant charge proportional to the difference of those charges.

2. The optic signals processor of claim 1, wherein the means in the transfer zone for subtracting charges includes for each pair of lines of the image zone a first capacitor receiving the charge form the first line of the pair, a second capacitor receiving the charge of the second line of the pair, means for switching said two capacitors in opposition and means for switching said two capacitors into series.

3. The optic signals processor of claim 1. wherein the means for subtracting charges comprise for each pair of lines of the image zone a capacitor having two plates;

means to couple and uncouple one of the plates to the cell of rank N of the first line and to couple and uncouple the other plate to the cell of rank N of the second line;

means to couple one of the plates of the capacitor to a constant potential and to uncouple the other plate from the cell to which it had been coupled.

4. The optic signals processor to claim 1, further comprising a memory zone having M lines ranking from 1 . . . m . . . to M, each line comprising N consecutive cells ranking from 1 . . . n . . . to N, each cell having means for receiving and transferring charges, the cell of rank one of line m receiving through an adder the charge delivered at line m of the transfer zone and transferring said charge to the next one of the memory zone, each cell of rank n of this zone transferring its charge to the cell of rank n + 1 up to the cell of rank N which charge is then transferred to the adder.

5. The optic signals processor to claim 4 in which the transfer zone further comprises for each line, charge divider means receiving charge delivered by the means for subtracting and delivering to the adder a charge which is a ratio of the received charge.

6. The optic signals of claim 5, wherein said charge divider means are capacitive divider means.

7. The optic signals of claim 4, wherein each line of the transfer zone comprises a capacitor having two plates, means for coupling and uncoupling one of the plates to a cell of rank N of the first line of a pair of the image zone, and the other plate of the capacitor to the cell of rank N of the second line, means for coupling one of the plate of the capacitor to a constant potential and for coupling the other plate to an adder.

8. The optic signals processor of claim 4, wherein said charge divider means are electrical dividers.

9. The optic signals processor of claim 5, wherein the ratio of division is of the order of 1/100.

10. The optic signals processor according to claim 4, wherein each line of the memory zone is split into two parallel half consecutive straight lines the first half line comprising the cells ranking from left to right from 1 to N/2 or (N − 2)/2 and the second half comprising the cells ranking from N/2 or (N +1) to N from right to left.

11. The optic signals processor according to claim 10, wherein the width of a pair of lines of the image zone is approximately equal to the width of two consecutive half lines of the memory zone.

12. A process to compute an ambiguity function of two functions $s_n(t)$ and $r_m(t)$ the function $s_n(t)$ being sampled by N samples of the form $S_n(t) \cos \omega t$ and the function $r_m(t)$ by M samples of the form $R_m(t) \cos (\omega t + p)$, the ambiguity function having at the end of an integration time T a value $$\sum_{t=0}^{t=T} s_n(t)\, r_m(t)$$

used an optic signals processor according to any one of claims 1 to 11 wherein each pixel of the first line of a pair of the processor being illuminated in sequence by a light beam issued from a source S modulated by the sampled signals Sn(t) and Rm(t), and each pixel of the second line being illuminated by the sampled signals Sn(t) an R*m(t), R*m(t) being Rm(t) phase shifted by $\pi$.

* * * * *